US005580845A

United States Patent [19]

Ruane

[11] Patent Number: 5,580,845

[45] Date of Patent: Dec. 3, 1996

[54] LUBRICANT

[75] Inventor: Patrick J. Ruane, Newbury, England

[73] Assignee: Castrol Limited, Wiltshire, England

[21] Appl. No.: 439,441

[22] Filed: May 11, 1995

Related U.S. Application Data

[63] Continuation of Ser. No. 172,240, Dec. 23, 1993, abandoned.

[30] Foreign Application Priority Data

Dec. 29, 1992 [GB] United Kingdom ..... 9227058

[51] Int. Cl.[6] ..... C10M 141/02

[52] U.S. Cl. ..... 508/161; 72/42; 508/463; 508/579

[58] Field of Search ..... 252/17, 12, 25, 252/27, 32.5, 52 A; 72/42

[56] References Cited

U.S. PATENT DOCUMENTS

| | | | |
|---|---|---|---|
| 2,530,838 | 11/1950 | Orozco et al. | 252/25 |
| 2,753,305 | 7/1956 | Whitbeck | 252/18 |
| 3,390,562 | 7/1968 | Rausch et al. | 252/18 |
| 4,575,430 | 3/1986 | Periard et al. | 252/12.6 |
| 4,607,675 | 8/1986 | Patitsas et al. | 252/21 |
| 4,687,350 | 8/1987 | Vogt et al. | 384/481 |
| 4,966,022 | 10/1990 | Stinnertz | 72/41 |
| 5,037,566 | 8/1991 | Randisi | 252/28 |
| 5,043,382 | 8/1991 | Meyer et al. | 252/32.5 |
| 5,076,339 | 12/1991 | Smith | 164/72 |
| 5,154,839 | 10/1992 | Hanano | 252/18 |
| 5,226,981 | 7/1993 | Meredith et al. | 72/367 |
| 5,227,831 | 1/1994 | Hanano | 252/25 |

FOREIGN PATENT DOCUMENTS

| | | |
|---|---|---|
| 0109515 | 5/1984 | European Pat. Off. . |
| 1136462 | 5/1957 | France . |
| 2190908 | 2/1974 | France . |
| 3324475 | 1/1985 | Germany . |
| 636248 | 12/1978 | U.S.S.R. . |
| WO90/13621 | 11/1990 | WIPO . |

*Primary Examiner*—Jacqueline V. Howard
*Attorney, Agent, or Firm*—Nixon & Vanderhye P.C.

[57] ABSTRACT

A lubricant suitable for use in an industrial forming process, especially cold pilgering, comprises a polyglycol as base fluid, a water-soluble inorganic filler and an organic filler.

21 Claims, 1 Drawing Sheet

LUBRICANT

This is a continuation of application Ser. No. 08/172,240, filed Dec. 23, 1993, now abandoned.

This invention relates to a lubricant suitable for use in industrial forming processes. It is particularly concerned with, but not limited to, a lubricant suitable for use in an industrial forming process for the production of seamless metal tubing known as cold pilgering. For convenience, therefore, the invention will be more specifically described below with reference to the cold pilgering process.

Cold pilgering refers to the production of tubing from thick-walled "shells" or "hollows" and involves a cold forging action between an internal mandrel and a pair of specially profiled rolls which act as a die.

The cold pilgering process is particularly useful for producing tubing from materials which easily work harden during deformation, such as stainless steels and alloys of zirconium and titanium and which are difficult or impossible to reduce by any other means. Also, a much higher reduction in cross sectional area is achievable by subjecting these materials to cold pilgering than is possible by conventional methods such as tube drawing. Often 90% or greater levels of reduction can be achieved by a single pass in the cold pilgering process.

The specially profiled rolls not only rotate during the operation but move along the longitudinal axis of the tubing offering a gradually decreasing aperture and progressively reducing the tubing diameter. The internal dimensions of the tubing are controlled by the tapered mandrel which supports the inside diameter of the tubing during its passage through the rolls. After each stroke, when the rolls have returned to their original position, the "shell" or "hollow" is twisted (i.e. rotated), normally through approximately 60 degrees, and advanced again.

The "shells" or "hollows" used in the cold pilgering process are normally produced by a hot extrusion process. For reasons principally of manufacturing economy it is normal to extrude a relatively small range of size i.e. diameters. Further intermediate sizes are then made from this small range by cold pilgering. It will be appreciated that considerable heat and pressure are generated during the pilgering process and so excellent lubrication is essential.

Two lubricants are normally used in the cold pilgering process, an internal lubricant between the mandrel and the tubing being drawn over it and an external one on the outside of the tubing, i.e. between it and the walls of the rolls. Often the same product can be used as both the internal and external lubricant in applications where small reductions of cross-sectional area (i.e. up to about 70%) are required. However, normally the compositions of the internal and external lubricants are substantially different.

Where large reductions in tubing diameter are being achieved, excellent lubrication is particularly essential as any failure, especially of the internal lubricant, could cause serious harm. For example, it is feasible that the pressure generated could cause the tubing to stick the mandrel, which would, of course, be a very expensive and time-consuming failure.

Conventionally, the internal and external lubricants used are based on chlorinated paraffins. Although offering adequate lubrication, these materials are not without problems. For example, the disposal of waste chlorinated paraffin lubricants represents an environmental problem. The tubing product, moreover, has to undergo a multi-stage cleaning process, normally requiring the use of hydrocarbon or even chlorinated solvents, to remove traces of the lubricant and this adds cost and further environmental problems to the overall process. However, in order to improve the performance of chlorinated paraffins in applications where large reductions or difficult to work alloys (such as high Nickel content stainless steels or the so-called 'DUPLEX' steels) are involved, it is normal to add a solid filler, e.g. chalk, to the internal lubricant formulation. Such fillers are insoluble in the lubricant base fluid and, although improving the performance of the lubricant, particularly in reducing the above-mentioned risk of sticking of tubing to mandrel, the solid particles of filler can become pressed into the wall of the tubing. A less than perfect surface finish is, therefore, obtained and the filler, being both solvent- and water-insoluble, adds to the difficulty of cleaning the finished tubing.

Typical external lubricants at the present time can contain up to 90% by weight of chlorinated paraffins as the base fluid. Internal lubricants, because they may contain inorganic fillers, tend to contain a lower level of chlorinated paraffin, normally of the order of around 60%.

The present invention aims to provide a lubricant, particularly suitable for, although not limited to, pilgering processes and especially for the internal lubrication of such processes, which lubricant avoids many of the aforesaid disadvantages of conventional lubricants.

Accordingly, the invention provides a lubricant comprising a polyglycol as base fluid, a water-soluble inorganic filler and an organic filler.

Preferably the polyglycol is water-soluble.

A water-soluble polyglycol is preferred because this allows the bulk of the resulting lubricant to be entirely soluble in water, greatly simplifying any process designed to ensure its removal from the finished tube. Where a water-insoluble or dispersible polyglycol is used the resulting lubricant may be more difficult to remove but once removed it will be easier to separate from an aqueous-based cleaning solution. In certain circumstances this may be useful in limiting the need to dispose of such aqueous-based solutions which may be advantageous in terms of lower overall costs or in reducing the overall level of discharges to the environment. Additionally, water-insoluble or dispersible polyglycol-based internal lubricants are favoured where water-based external lubricants are used to limit any cross-contamination.

The polyglycol may be any suitable polymer built randomly or sequentially of alkylene oxide units onto an initiator or starter molecule. The alkylene oxide units are preferably derived from ethylene oxide, propylene oxide or butylene oxide or mixtures thereof.

The hydroxyl functionality of the starter molecule will determine the functionality of the final molecule. The use of water or glycol, for example, will yield a diol whereas the use of glycerol as a starter will give a branched chain triol.

A wide variety of other chemical species may be considered as starter molecules, for example, phenols. Further variations in properties can be achieved using mixtures of the alkylene oxides, e.g. mixtures of ethylene and propylene oxides, when a random copolymer is obtained or by using a homopolymer of one type as the starter for the other type, when a block or sandwich copolymer will be obtained, depending on whether the starter was mono- or di-functional.

The polyglycol product may be used with free hydroxyl functionality or may be further modified by generation of carboxylate groups, producing the so-called 'acid-grafted' polyglycols.

Further useful polyglycols may be obtained by the dehydration of glycols. For example, polymers of trimethylene glycol and tetramethylene glycol and copolymers with ethylene and propylene glycols can be prepared by direct reaction of the glycols using a dehydration catalyst.

As indicated above, it is a preferred embodiment of the invention that the polyglycol be water-soluble. Most polyglycols based on ethylene oxide as the sole alkylene oxide constituent will be water-soluble (although above about 700 molecular weight they will be solid at room temperature.) Those based solely on propylene oxide will be water-soluble up to about 500 molecular weight. Other polyglycols based on diols, triols, diethers, ether alcohols and similar structures may, as indicated, be based on polyethylene glycol, polypropylene glycol or a carbon block, sandwich or graft copolymer of the two monomers. However, for water-solubility in higher molecular weight and hence higher viscosity polyglycols, the level of propylene oxide will be limited in most cases to 50% in molar terms, i.e. 1 mole propylene oxide to 1 mole ethylene oxide and preferred materials may contain rather less, e.g. 25% molar proportion of propylene oxide.

The proportions by weight of the three principle constituents of the lubricants of the invention are as follows:

| | |
|---|---|
| polyglycol base fluid | 20–98% |
| inorganic filler | 1–50% |
| organic filler | 1–30% |

Suitable water-soluble inorganic fillers include boric acid and the following sodium or potassium salts:

bicarbonate, carbonate, metaborate, perborate, tetraborate, metasilicate, tetrasilicate, molybdate, orthophosphate, polyphosphate, and sulphate.

However, it should be noted that in tubing destined for the nuclear industry, boric acid and salts containing boron cannot be used, (that is the inorganic filler must be boron-free) as traces of boron contaminating the finished tube present a safety hazard. A filler selected from benzoate, citrate and tartrate also may be provided.

Suitable organic fillers include (i) mono-amides of the general formula

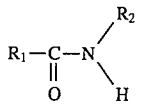

where $R_1$=alkyl, preferably $C_{12}H_{25}$ to $C_{24}H_{49}$ alkyl $R_2$=H or alkyl, $C_{12}H_{25}$ to $C_{24}H_{49}$ A specific, preferred example is stearamide, which is available as UNIWAX 1750 from Unichema International.

(ii) bis-amides of the general formula

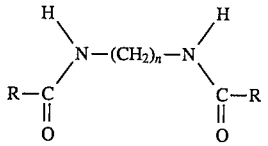

where

R=alkyl, preferably $C_{12}$ to $C_{24}$ alkyl n=2 to 6

A specific preferred example is ethylene bis-stearamide, which is available as UNISLIP 1762 EBS from Unichema International.

The fillers are preferably of relatively fine size, for example, approximately 98% of the inorganic filler should have a particle size of less than 125 microns. Similarly approximately 95% of the organic filler should preferably have a particle size of less than 75 microns.

Although not wishing to be limited to any particular theory, it is believed that the organic filler may be playing a dual role. Initially, it acts as a suspending agent, helping to prevent the settling out of the inorganic filler. During the application it is melted by the heat generated during the deformation process and in its liquid form aids lubrication.

In addition to the base fluid and filler constituents above-described, the lubricant may also contain one or more of the following additives.

One or more additional suspension agents may be used to ensure that the mixture remains homogeneous. Suitable suspension agents include alkali metal or amine soaps of carboxylic acids with carbon numbers from $C_{12}$ to $C_{24}$. They are preferably used in an amount of from 0.1 to 5% by weight based on the total composition.

An antioxidant may be needed to reduce the formation of oxidised residues around the mandrel and in the lubricant, particularly in view of the fact that cold pilgering can induce temperatures in the area of the mandrel in excess of 200° C. Suitable examples include phenolic or amine-based antioxidants, well known in the art, e.g. butylated hydroxy toluene. They are preferably used in an amount from 0.01 to 2.0% by weight based on the total composition.

Extreme pressure/antiwear additives may be used to reduce wear on the mandrel. Many are well known in the art and include:

powdered sulphur, overbased petroleum sulphonates, dithiophosphonates, thiophosphonates, sulphurised olefins, polysulphides, organic acid phosphates, organic phosphites, sulphurised fatty esters or acids, e.g. sulphurised oleic acid, and proprietary water-soluble sulphur-based extreme pressure additives.

They are preferably used in an amount from 0.1 to 20.0% by weight based on the total composition.

The choice of base fluid, organic filler and, particularly, inorganic filler will determine which, if any, of the other additives will be needed but this will be a matter within the skills of the average skilled man of the art.

Lubricants of the invention have valuable properties and significant advantages over those used hitherto.

It is possible to choose polyglycol base fluids which have very high flash points, certainly as high as 240° C., which is sufficient to avoid any danger of flashing when the tube leaves the rolls, even after the most severe reductions. Chlorinated paraffin-based products are not flammable, but above about 130° C. the chlorinated paraffin-based products decompose to give fumes which are strongly acidic and can cause health problems as well as machine corrosion. The lubricants of this invention do not fume so readily because of their high flash points, do not decompose and any mists which may be generated by excessive heating are non-corrosive.

The used lubricant is a soft gel that can readily be cleaned from the mandrel and tube without the need for less environmentally-friendly and more expensive solvents. A single stage washing using water-based alkaline cleaners is often all that is required and the base fluid in the spent lubricant is biodegradable. The fillers do not become embedded in the tube or mandrel surface because of their solubility (or low melting point) so that the above-mentioned problems of spoiling the surface and difficulty of removal are avoided.

Lubricants of the invention have been found to provide excellent quenching of the tube and can reduce the mandrel operating temperature to the range 140° C. to 160° C., for example, i.e. they are equivalent to and often better than chlorinated paraffin lubricants in this important respect without having the above-mentioned disadvantages of chlorinated paraffins. Since the lubricants of the invention ensure that the levels of heat generated in the mandrel are low (i.e. less than 200° C.) and they do not break-down to give acidic and hence corrosive by-products, they also reduce the risk of damage to the more expensive chromium-plated mandrels which are often used. With chlorinated paraffin-based products excessive temperatures lead to chemical attack on the chrome plating by the acidic break-down products, which can cause blistering and subsequent rupture of the plated layer.

It should be pointed out that the 'base fluid' used in the invention need not necessarily be liquid at ambient temperatures. It is also intended to embrace a solid dissolved in a liquid or a polyglycol which is only liquid at temperatures up to nearly the actual working temperature of the metal forming process in question. Thus, a solid polyethylene glycol, for example, may be dissolved in a liquid polyethylene glycol to give a "base fluid" which is only liquid above ambient temperatures (e.g. 20° C.). Alternatively, a solid polyethylene glycol may be used which has a melting point above ambient temperature and which must first be subjected to heating before use, either directly or as a result of contact with the processing operation.

The viscosity of the lubricant of the invention is dependent on the severity of individual applications and may be as high as 120,000 centiPoise at 40° C. The preferred viscosity range for pilgering application is 2,000 to 60,000 centiPoise at 40° C.

When used as an internal pilgering lubricant, the lubricants of the invention may be used with any suitable external lubricant capable of ensuring acceptable lubrication to the rolls and minimising wear and pick-up on both rolls and tube. Thus, they may be used with water-soluble synthetic metalworking fluid solutions, soluble oil emulsions or water-insoluble conventional (mineral oil or chlorinated paraffin based) external lubricants. They can also be used with polyglycol-based external lubricants and in these circumstances, it is normal to use different types of external lubricant depending on which type of polyglycol is used as the base fluid for the internal lubricant. If a water-soluble polyglycol is used as the internal lubricant, the external lubricant is preferably based on a water-insoluble polyglycol and vice versa. This facilitates easier separation of internal lubricant from the external, minimising the contamination of the external lubricant and, hence, extending external lubricant lifetimes. However, there is no absolute requirement to follow this procedure if particular operational requirements dictate otherwise.

In the preferred embodiment, the internal lubricant of the invention is based on a water-soluble polyglycol and the external lubricant is based on mineral oil. Since the internal lubricant is not soluble in the external lubricant it may easily be separated from it by sedimentation, filtering or centrifuging. Thus, the working life of the external lubricant can be significantly extended.

Another advantage of the lubricants of the present invention in the pilgering process is that they readily lend themselves to accurate "single shot" feeding into the preliminary "shell" or "hollow". This procedure greatly reduces the volume of lubricant required to effect the process and ensures the use of clean new lubricant on every reduction. The resulting elimination of contamination, resulting from materials which build up in recirculated internal lubricants, such as dirt, metal fines etc., contributes significantly to the quality of the finished tube. It also prolongs mandrel life and reduces roll wear by preventing detrimental changes in the level of internal lubrication which can adversely affect external tube conditions as a result.

As only sufficient internal lubricant is applied to form the tube there is virtually no wastage, which reduces costs, minimises contamination of the external lubricant and contributes to improved cleanliness of the pilgering machine and surrounding areas.

As indicated above, although primarily designed for cold pilgering, the lubricants of this invention are also suitable for other deformation operations where the requirements for lubrication are not so severe. In particular where materials which are subject to work hardening such as stainless steel and zirconium or titanium alloys are being used, lubricants of the above invention can be formulated to effect their deformation. Examples of applications where the lubricants of this invention could also be used include the deep-drawing, pressing, blanking or stamping of sheet or strip metal. In addition, suitably formulated lubricants could also be used for cold heading and cold extrusions of billets, rod or wire made of the materials indicated. The drawing through a die of tubes, bars, rod and wire could also be effectively lubricated with the formulations of the invention.

Again, although primarily intended for use in connection with stainless steel, zirconium and titanium, the formulations of the above invention could similarly be used in any of the applications indicated above in connection with other ferrous metals such as carbon or other alloyed steels. However, the formulations of the invention may not be suitable for the deformation of non-ferrous metals, and in particular, copper, brass or aluminium. This is because of the negative effects likely on the surface finish of the resulting components caused by the presence of the inorganic filler.

DETAILED DESCRIPTION OF THE DRAWINGS/SPECIFIC EXAMPLES

A typical cold pilgering process is illustrated diagrammatically in FIGS. 1 and 2 of the accompanying drawing and the invention is further illustrated by way of example only in the following Examples.

Figure 1:
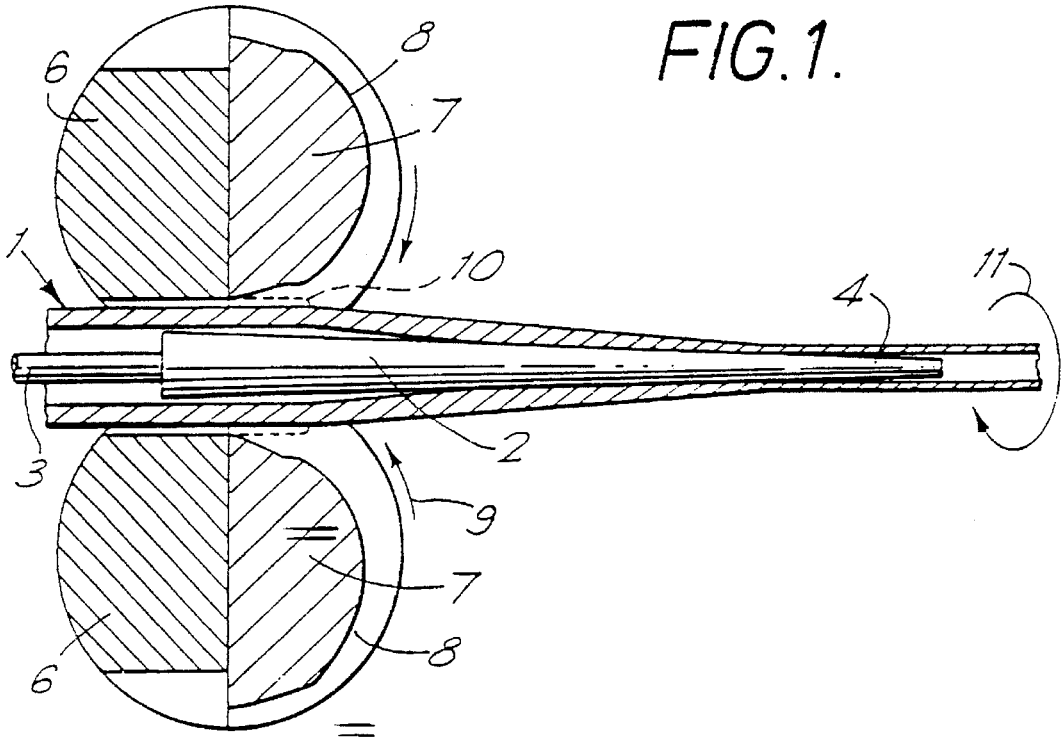
FIGS. 1 and 2 are schematic side views, partly in cross section and partly in elevation, showing a cold pilgering process utilizing the lubricant according to the present invention.
Figure 2:
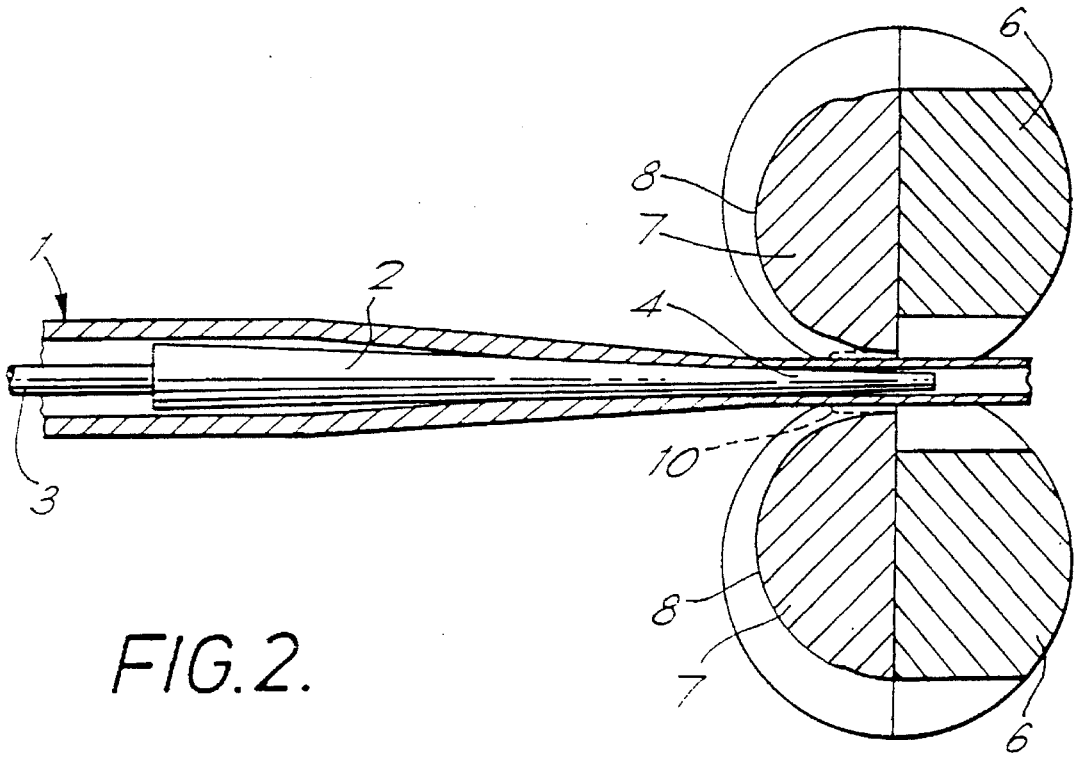

In FIGS. 1 and 2 of the drawing the tubular workpiece 1 is supported internally by mandrel 2 projecting from rod 3 and tapering to a point 4 of external diameter corresponding to the required final internal diameter of the tube. The tube 1 is shaped by means of a pair of profiled rolls 6 which each have a die 7 defining a gradually tapered groove 8, the grooves on the two rolls matching and converging during rotation of rolls 6 in the direction shown by arrows 9 to produce a reduction in form. Dotted lines 10 illustrate the path of the dies when out of contact with the tube wall.

FIG. 1 illustrates the position of the dies at the start of the stroke while FIG. 2 illustrates the position at the end of the stroke. The tube 1 is fed inwards in small increments before each stroke over mandrel 2 and the tube is rotated approximately 60° C. after each stroke as illustrated by arrow 11.

The following are examples of utilization of lubricants according to the present invention in actual cold pilgering process, in each case the lubricant set forth being water-free.

EXAMPLES

Example 1

| | |
|---|---|
| Machine: | Robertson Pilgering Mill |
| Material: | ASTM A312-TP 310S Stainless Steel |
| Start (Hollow) Size: | 48.3 mm OD × 41.3 mm Bore (wall thickness 3.5 mm) × 4 m long |
| Finish (Tubing) Size: | 25.4 mm OD × 20.1 mm Bore (wall thickness 2.65 mm) |
| Reduction of Cross Section Area: | 61.55% |
| Stroke Speed: | 85 per minute |
| Die Type: | Half Ring |
| Lubricants | |
| Internal: | 60% Breox 75 W 18,000<br>30% Sodium Bicarbonate Powder<br>10% Ethylene Bis-Stearamide Powder |
| External: | Commercial mineral oil based chlorine containing product |

The Breox constituent (obtained from BP Chemicals) is a water-soluble polyglycol containing 75 mole per cent ethylene oxide units and 25 mole per cent propylene oxide units and having a viscosity at 40° C. of 18,000 centi Stokes ($mm^2$)/second.

The trial which took place over a period of 2 days gave no problem with tube quality and there was no sign of mandrel wear or pick-up during the trial period. (Pick-up is transfer of small metal particles from the surface of the mandrel to the tube's inner surface or vice versa.)

Example 2

| | |
|---|---|
| Machine: | Robertson Pilgering Mill |
| Material: | AISI 304L Stainless Steel |
| Start (Hollow) Size: | 48.3 mm OD × 38.14 mm Bore (wall thickness 5.08 mm) × 3 m long |
| Finish (Tubing) Size: | 21.2 mm OD × 38.14 mm Bore (wall thickness 2.14 mm) |
| Reduction of Cross Section Area: | 81.6% |
| Stroke Speed: | 80 per minute |
| Die Type: | Half Ring |
| Lubricants | |
| Internal: | 60% Breox 75W18,000<br>30% Sodium Bicarbonate Powder<br>10% Ethylene Bis-stearamide Powder |
| External: | Commercial mineral oil based chlorine containing product |

This trial, which took place over a period of 1.5 days, gave no problem with tube quality and there was no sign of mandrel wear or pick-up during the trial period.

Example 3

| | |
|---|---|
| Machine: | Mannesmann Meerag |
| Material: | DIN 1.4306 (TP 304L) Stainless Steel |
| Start (Hollow) Size: | 33.7 mm OD × 29.2 mm Bore (wall thickness 2.25 mm) |
| Finish (Tubing) Size: | 18.0 mm OD × 16.5 mm Bore (Wall thickness 1.25 mm) |
| Reduction of Cross Section Area: | 81.7% |

-continued

| | |
|---|---|
| Stroke Speed: | 150 per minute |
| Die Type: | Full Ring |
| Feed Rate: | 6.0 mm/stroke |
| Lubricants | |
| Internal: | 30% Breox 75 W18,000<br>30% Breox 75 W270<br>30% Sodium Bicarbonate Powder<br>10% Ethylene Bis-Stearamide Powder |
| External: | Experimental mineral oil based, chlorine-free product. |

This trial which took place over a period of two days gave no problems with internal tube quality and there was no sign of mandrel wear of pick-up at the end of the trial.

Breox 75 W270 (obtained from BP Chemicals) is similar to Breox 75 W18,000 described in Example 1 but has a viscosity at 40° C. of 270 centi Stokes ($mm^2$)/second.

Example 4

| | |
|---|---|
| Machine: | S.S.M 50 |
| Material: | DIN 1.7458 (WZ 1990) Stainless Steel |
| Start (Hollow) Size: | 48.3 mm OD × 38.14 mm Bore (wall thickness 5.08 mm) |
| Finish (Tubing) Size: | 25.4 mm OD × 19.4 mm Bore (wall thickness 3.0 mm) |
| Reduction of Cross Section Area: | 69.4% |
| Stroke Speed: | 140 per minute |
| Die Type: | Full Ring |
| Feed Rate: | 3.5 mm/stroke |
| Lubricants | |
| Internal: | 30% Breox 75 W18,000<br>30% Breox 75 W270<br>30% Sodium Bicarbonate Powder<br>10% Ethylene Bis-Stearamide Powder |
| External: | Commercial mineral oil based chlorine-containing product. |

This trial took place over a period of around 6 hours and gave no evidence of problems with regard to internal tube quality, mandrel wear of pick-up.

Cleaning tests on the finished tube using an aqueous alkaline cleaner solution showed the internal lubricant to be easier to remove than a filled, chlorinated paraffin based lubricant previously used to effect this operation.

Example 5

| | |
|---|---|
| Machine: | Robertson Pilgering Mill |
| Material: | ASTM A789-90 (Duplex) |
| Start (Hollow) Size: | 48.3 mm OD × 41.3 mm Bore (wall thickness 3.5 mm) |
| Finish (Tubing) Size: | 25.4 mm OD × 20.1 mm Bore (wall thickness 2.65 mm) |
| Reduction of Cross Section Area: | 61.55% |
| Stroke Speed: | 85 per minute |
| Die Type: | Half Ring |
| Lubricants | |
| Internal: | 60% Breox 75 W18,000<br>30% Sodium Bicarbonate<br>10% Ethylene Bis-Stearamide Powder |
| External: | Commercial mineral oil based chlorine-containing product. |

Although this test was carried out on a relatively small number of hollows, numbering about 20, no problems were observed with regard to internal lube quality, despite the normal difficulties associated with cold pilgering Duplex steels. Similarly, no evidence of mandrel wear or pick-up was observed.

I claim:

1. A fluid water-free lubricant, suitable for use in a cold pilgering process, comprising a polyglycol as base fluid, a water-insoluble, boron-free inorganic filler and an organic filler, combined to be fluid water-free and suitable for use in a cold pilgering process.

2. A lubricant according to claim 1, wherein the compositions and proportions of the base fluid and fillers such as the lubricant are suitable for use as an internal lubricant in the cold pilgering of seamless stainless steel, zirconium or titanium tubes.

3. A lubricant according to claim 1 wherein the polyglycol is water-soluble.

4. A lubricant according to claim 3, wherein the polyglycol is based on ethylene oxide comprising up to 50 mole % of propylene oxide.

5. A lubricant according to claim 1, wherein the polyglycol is water-insoluble or dispersible.

6. A lubricant according to claim 1 wherein the proportions by weight of the polyglycol, inorganic filler and organic filler are as follows:

| | |
|---|---|
| polyglycol base fluid | 20–98% |
| inorganic filler | 1–50% |
| organic filler | 1–30%. |

7. A lubricant according to claim 1 wherein the inorganic filler is selected from sodium or potassium salts selected from bicarbonate, carbonate, metasilicate, tetrasilicate, molybdate, orthophosphate, polyphosphate, and sulphate.

8. A lubricant according to claim 1 wherein the organic filler is selected from:

(i) mono-amides of the general formula

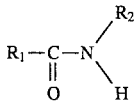

where $R_1$=alkyl $R_2$=H or alkyl $C_{12}H_{25}$ to$C_{24}$ $H_{49}$, and (ii) bis-amides of the general formula

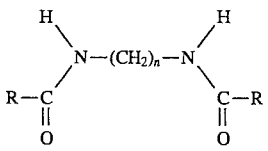

where

R=alkyl n=2 to 6.

9. A lubricant according to claim 1 wherein about 98% of the inorganic filler has a particle size of less than 125 microns and about 95% of the organic filler has a particle size of less than 75 microns.

10. A lubricant according to claim 1 further comprising one or more additional additives selected from suspension agents, antioxidants and extreme pressure/antiwear additives.

11. A lubricant according to claim 3 wherein the inorganic filler is selected from sodium or potassium salts selected from bicarbonate, carbonate, metasilicate, tetrasilicate, molybdate, orthophosphate, polyphosphate, and sulphate.

12. A lubricant according to claim 3 wherein about 98% of the inorganic filler has a particle size of less than 125 microns and about 95% of the organic filler has a particle size of less than 75 microns.

13. A lubricant according to claim 3 further comprising one or more additional additives selected from suspension agents, antioxidants and extreme pressure/antiwear additives.

14. A lubricant according to claim 3 wherein the proportions by weight of the polyglycol, inorganic filler and organic filler are as follows:

| | |
|---|---|
| polyglycol base fluid | 20–98% |
| inorganic filler | 1–50% |
| organic filler | 1–30%. |

15. A lubricant according to claim 5 wherein the proportions by weight of the polyglycol, inorganic filler and organic filler are as follows:

| | |
|---|---|
| polyglycol base fluid | 20–98% |
| inorganic filler | 1–50% |
| organic filler | 1–30%. |

16. A lubricant according to claim 5 wherein the inorganic filler is selected from sodium or potassium salts selected from bicarbonate, carbonate, metasilicate, tetrasilicate, molybdate orthophosphate, polyphosphate, and sulphate.

17. A lubricant according to claim 5 wherein about 98% of the inorganic filler has a particle size of less than 125 microns and about 95% of the organic filler has a particle size of less than 75 microns.

18. A lubricant as recited in claim 1 consisting essentially of a polyglycol base fluid, a water soluble inorganic filler, and an organic filler.

19. A lubricating method comprising the step of during the cold pilgering of seamless stainless steel, zirconium, or titanium tubes, providing an internal lubricant during the cold pilgering process, the internal lubricant comprising a polyglycol as base fluid, a water-soluble inorganic filler, and an organic filler.

20. A lubricating method as recited in claim 19 wherein said step of providing an internal lubricant is practiced by providing a fluid, water-free lubricant with a boron-free inorganic filler.

21. A lubricant according to claim 1 further comprising a filler selected from benzoate, citrate, and tartrate.

* * * * *